United States Patent [19]

Mayer et al.

[11] Patent Number: 4,776,575

[45] Date of Patent: Oct. 11, 1988

[54] ELECTROPHOTOGRAPHIC COPYING APPARATUS INCORPORATING AN AUTOMATIC ADHESIVE SHEET FEEDING METHOD AND APPARATUS

[75] Inventors: Edward F. Mayer, Santa Clara County; Carl P. Anderson, San Mateo County, both of Calif.

[73] Assignees: Ricoh Co., Ltd., Tokyo, Japan; Ricoh Corporation, San Jose, Calif.

[21] Appl. No.: 931,181

[22] Filed: Nov. 17, 1986

[51] Int. Cl.[4] ..... B65H 3/20

[52] U.S. Cl. ..... 271/33

[58] Field of Search ..... 271/33, 21, 22

[56] References Cited

U.S. PATENT DOCUMENTS

| | | | |
|---|---|---|---|
| 3,625,507 | 12/1971 | Lucius | 271/33 |
| 3,713,645 | 1/1973 | Ferrari | 271/21 X |
| 4,577,851 | 3/1986 | Müller | 271/33 |

FOREIGN PATENT DOCUMENTS

| | | | |
|---|---|---|---|
| 202230 | 11/1983 | Japan | 271/33 |

*Primary Examiner*—Richard A. Schacher

*Attorney, Agent, or Firm*—Flehr, Hohbach, Test, Albritton & Herbert

[57] ABSTRACT

A sheet feeder is disclosed having a cartridge mounted adjacent the stack of paper providing an exposed line of adhesive strip. The adhesive should be a temporary adhesive which when removed leaves no residue or damage on the sheet to which it was temporarily bonded. The cartridge is landed on the top sheet of paper adjacent the leading edge of the sheet, and the cartridge is then rotated away from the direction in which the sheet is to be fed while maintaining a minimum amount of pressure on the top of the stack. This effectively bonds the gummed strip on the cartridge to the edge of the top sheet of paper; and the motion away from the feeding direction lifts the top edge of the sheet from the edge of the sheet below, which now forms the top of the stack. The sheet below, also to be called the second sheet, remains in place because of the combination of downward pressure against the second sheet near its leading edge created by the cartridge, together with the beam strength of the paper which tends to cause the sheet to continue to lie flat. The cartridge can now be moved in the feeding direction, presenting the sheet of paper to an entry path to the copying machine.

15 Claims, 6 Drawing Sheets

ELECTROPHOTOGRAPHIC COPYING APPARATUS INCORPORATING AN AUTOMATIC ADHESIVE SHEET FEEDING METHOD AND APPARATUS

The present invention relates generally to electrophotographic copying apparatus and more particularly to one designed to make copies using an automatic arrangement for feeding successive sheets of paper taken from the top of a stack of blank sheets of paper.

It is highly desirable in today's high speed, multicopy machines to provide a means in the copy machine for automatically feeding single sheets of paper, sheet by sheet, into the machine. However, a number of problems present themselves any analysis of this problem.

The force required to move the top blank sheet of paper off the stack tends to have a self contradictory effect. Specifically, increasing the friction between the driving device which is drawing the sheet off the stack and the top sheet results in an increased coupling between the top sheet and the underlying sheet.

Therefore, it is an objective of this invention to provide a sheet-feeding device which utilizes a minimal force against the top of the stack of blank paper, to minimize coupling betwen the sheets.

A further serious consideration in design of automatic top sheet feeders is taking into account the coupling between the top sheet and the rest of the stack. This coupling is essentially of two types. One type is created by air pressure. That is, the force required to lift one sheet off vertically becomes greater as the lifter moves from the edge of the sheet. With the edges of the sheets together, and the flexible nature of a sheet of paper, the top sheet interacts with the sheet below much like a vacuum, and full atmospheric pressure against the top sheet resists the lifting motion.

Thus, it is an objective of the present invention to design a sheet feeder which avoids attempting to apply the lifting force away from the edge of the sheet, and more specifically, to design a sheet feeder which first lifts the edge of the sheet to be withdrawn away from the underlying stack to minimize the force required.

A further difficulty in separating the top sheet from underlying sheets is in overcoming mechanical engagement of fibers along the edges of sheets. Typically, one or two sheets in each ream suffer from this kind of fiber coupling. Therefore, another objective herein is to provide a sheet feeder which is adapted to disengage the edge of each sheet from the underlying sheet in a manner which will eliminate fiber coupling of the sheets.

It has been thought the easiest way to separate sheets in a mechanical sheet feeder is to slide one sheet off the other. Basically, copiers now provide sheet feeding mechanisms utilizing a feed roller which engages the lead edge of the paper stack and by friction, slides the paper forward. A second pad or roller engages the bottom side of the sheet and halts any sheet which may be carried with the one being fed from entering the machine. This system relies on the higher friction of the feed roll versus the retarding roll or pad which underlies the blank sheet to be fed.

It is an objective of this invention to provide an improvedmethod of and apparatus for first lifting the edge of the blank sheet to be withdrawn from a stack, and thereafter sliding the sheet forward for presentation to the copying system.

As discussed above, and as will be seen in the detailed description to follow, the paper feeding arrangement designed in accordance with this invention is especially useful in electrophotographic copying apparatus designed to make successive copies by using a continuous copy paper feeding arrangement. The arrangement of this invention is configured to act on the stack of paper in a way which draws successive sheets of paper from the top of the stack and feeds them individually into the copy machine. A typical copy machine with which this apparatus is useful is disclosed in U.S. Pat. No. 4,384,784, assigned to the Assignee of this invention, and incorporated herein by reference. A sheet feeder of the type with which this invention would be useful is disclosed in U.S. Appln. Ser. No. 732,608, filed May 10, 1985 now U.S. Pat. No. 4,619,450, in the name of C. Anderson and assigned to the Assignee of this invention, and incorporated herein by reference.

The sheet feeder of the present invention specifically comprises a cartridge mounted adjacent the stack of paper having a line of adhesive strip of the type popularized for "Post-It" pads made by 3M Corporation essentially comprising butyl acrylate. The adhesive should be a temporary adhesive which when removed leaves no residue or damage on the sheet to which it was temporarily bonded. The cartridge is landed on the top sheet of paper adjacent the leading edge of the sheet, and the cartridge is then rotated away from the direction in which the sheet is to be fed while maintaining a minimum amount of pressure on the top of the stack. This effectively bonds the gummed strip on the cartridge to the edge of the top sheet of paper; and the motion away from the feeding direction lifts the edge of the sheet from the edge of the sheet below, which now forms the top of the stack. The sheet below also to be called the second sheet, remains in place because of the combination of the downward pressure against the second sheet near its leading edge created by the cartridge, together with the beam strength of the paper which tends to cause the sheet to continue to lie flat. The cartridge can now be moved in the feeding direction, presenting the sheet of paper to an entry path to the copying machine.

Preferably, a feed roller is place adjacent the stack of paper. Forward movement of the cartridge brings it to a position closely adjacent the feed roller, so that the blank sheet is pressed between the cartridge and the roller. Rotation of the roller feeds the sheet forward. A sheet pick-off element is provided adjacent the cartridge to pick the blank sheet of paper off of the gummed strip of the cartridge as the feed roller rotates. Upon completion of the feeding cycle with the blank sheet now picked off and forwarded, the cartridge is positioned to be ready for re-use in automatically feeding the next sheet of paper.

An additional element is preferably provided to aid in the separation of the top sheet from the remainder of the stack. This comprises a barrier or fence placed across the front of the stack of blank paper, of the same height or slightly higher than the stack of paper. When the leading edge of the sheet to be withdrawn is raised, it is automatically raised higher than the level of the fence and may be withdrawn past the fence; any residual bonding between the sheet being withdrawn and the remaining stack is overcome by the fence so that the paper stack does not creep forward.

These and other objectives of this invention are achieved in a preferred embodiment of this design wherein FIG. 1A is a side elevational view of a cartridge for feeding single sheets of paper into a copying machine including representative mechanics for positioning the cartridge relative to the sheet, the cartridge being shown in a first, or at-rest position;

Figure 1A:
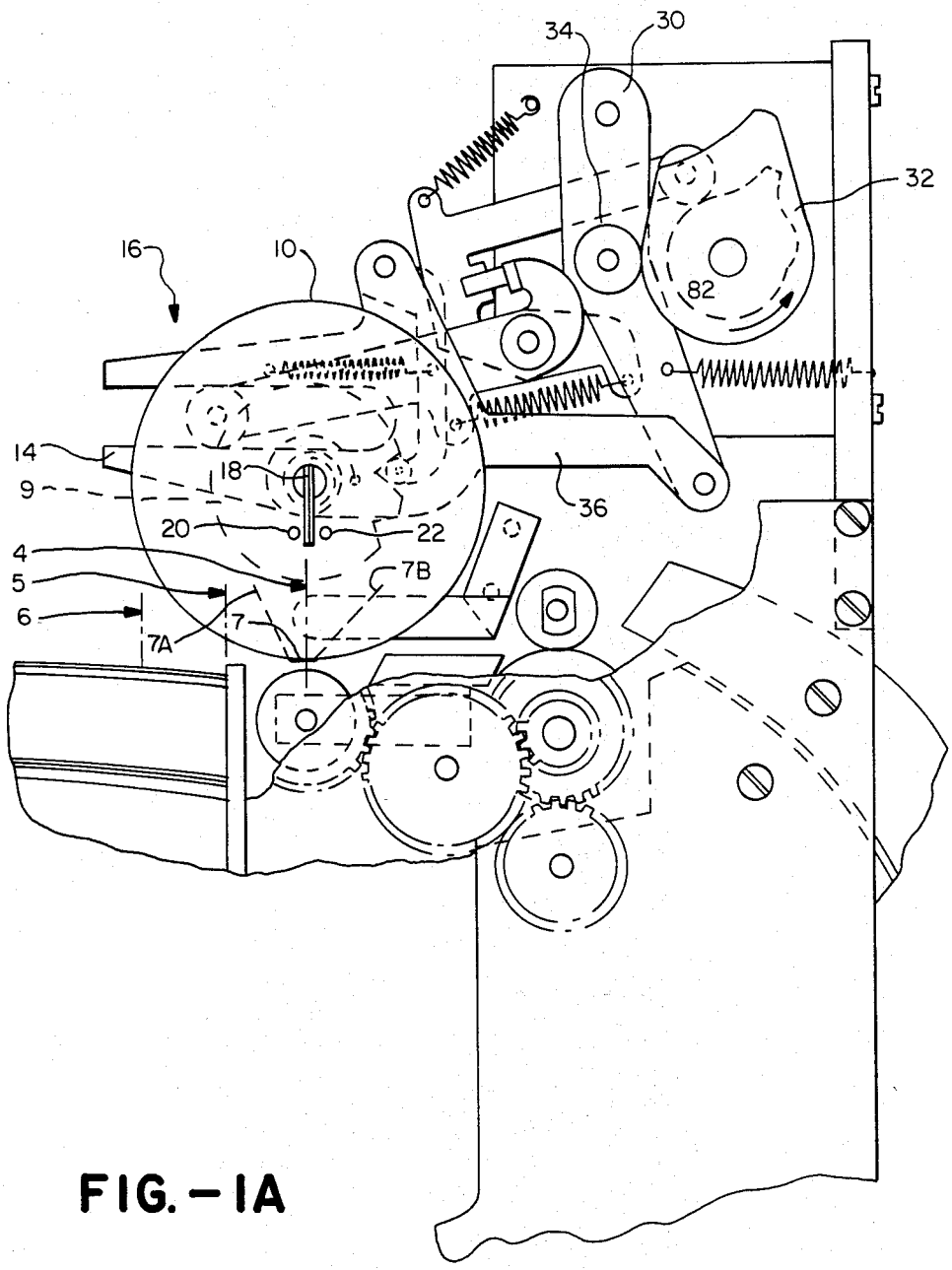
FIGS. 1B and 1C illustrate the movement of the cartridge which occurs to lift and remove a sheet of paper.
Figure 1C:
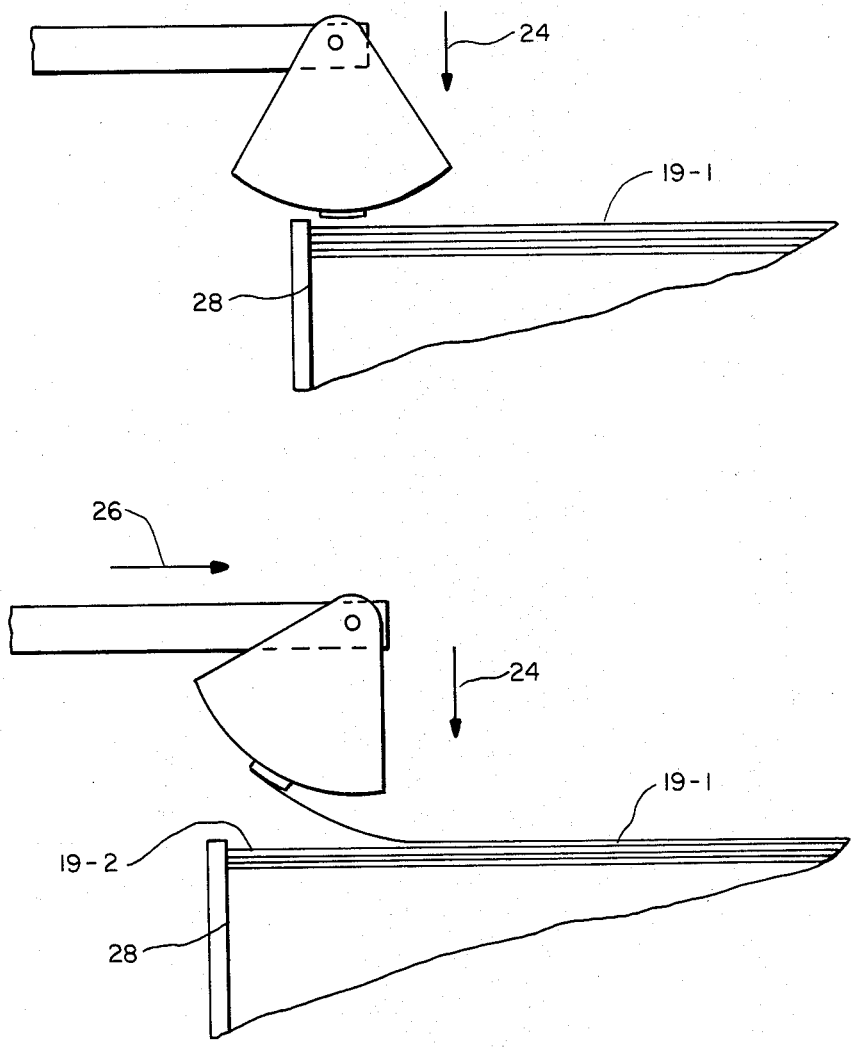
Figure 2:
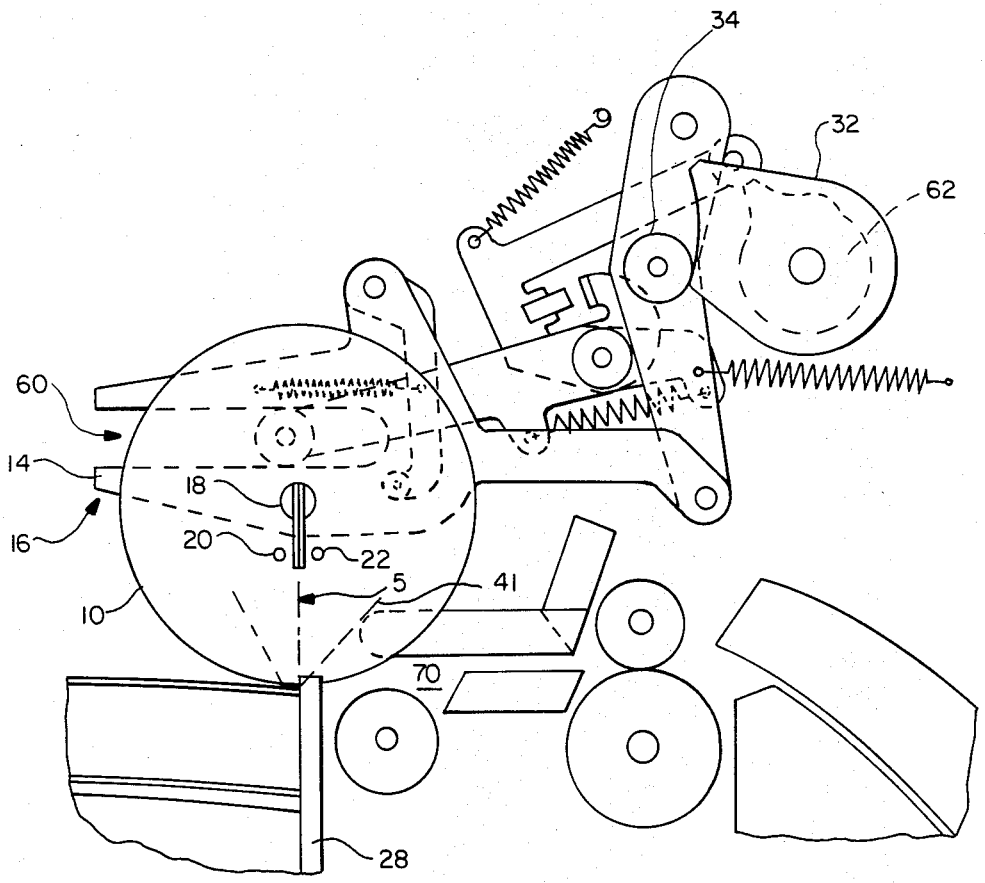
FIG. 2 shows the cartridge of FIG. 1 advanced to the position where the gummed strip on the cartridge contacts the leading edge of the sheet of paper (as schematically shown in FIG. 1B)
Figure 3:
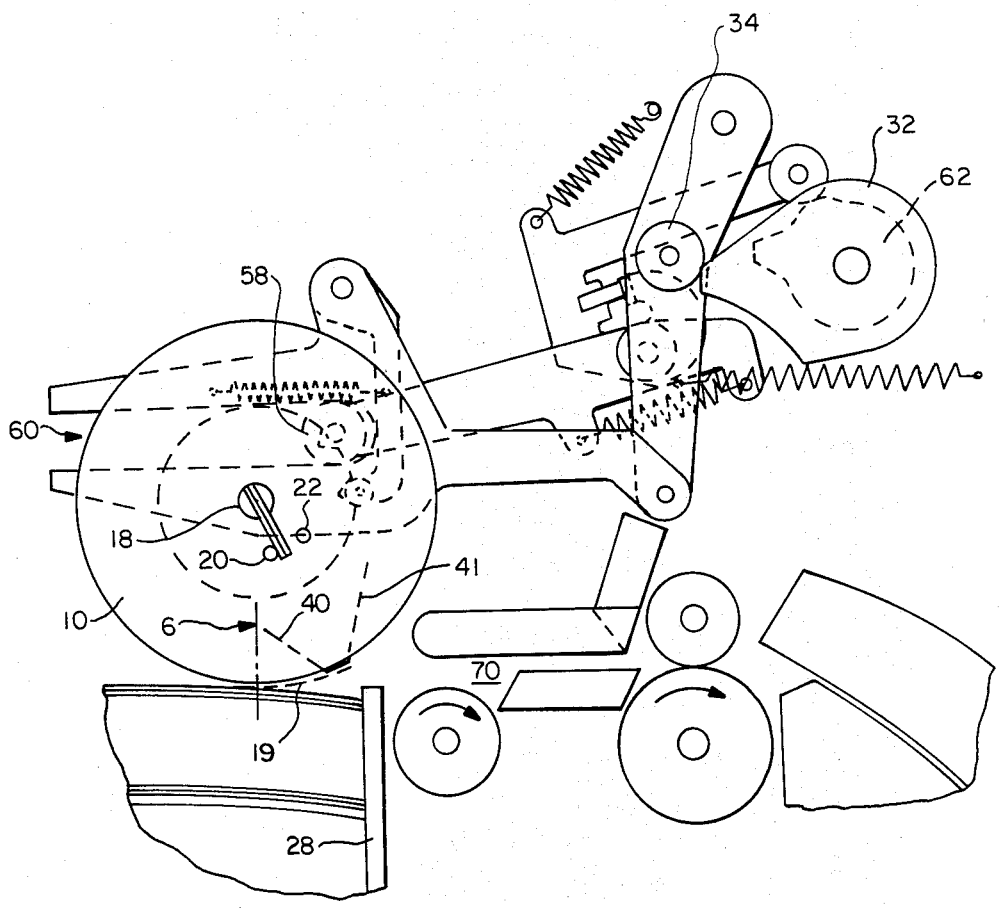
FIG. 3 shows the cartridge of FIG. 1 moved away from the entry to the feeding station together with positioning of the associated mechanics to cause this rotation (as schematically shown in FIG. 1C)
Figure 4:
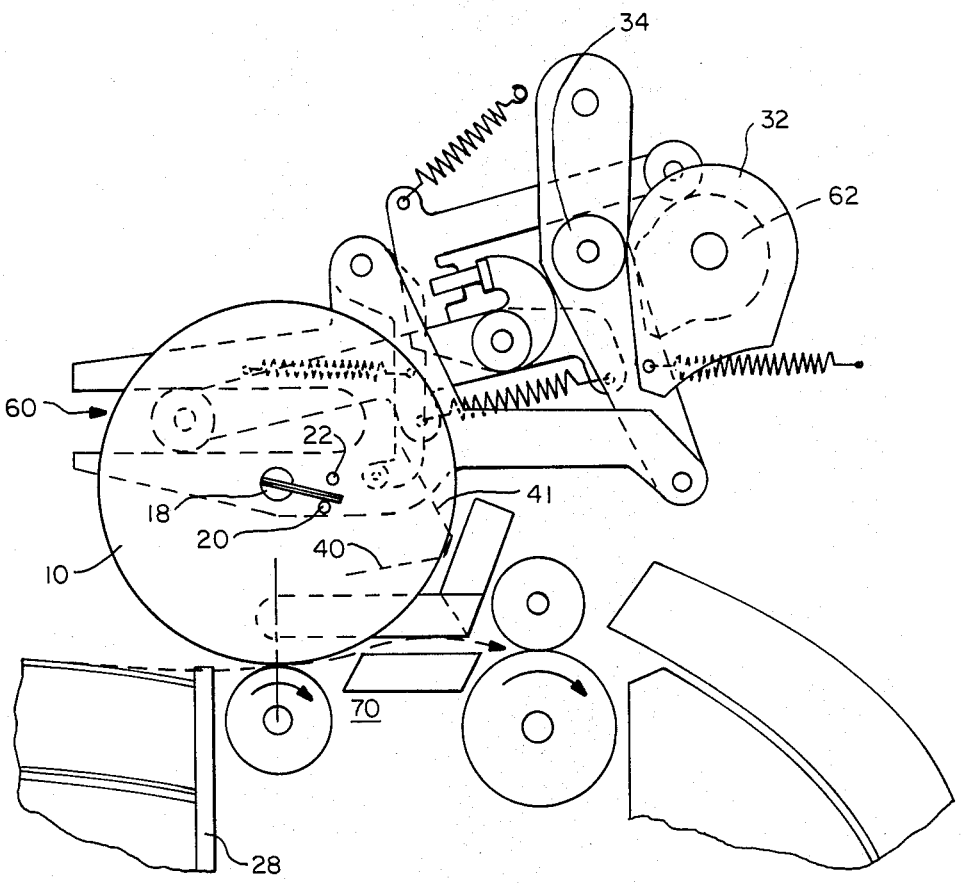
Figure 5:
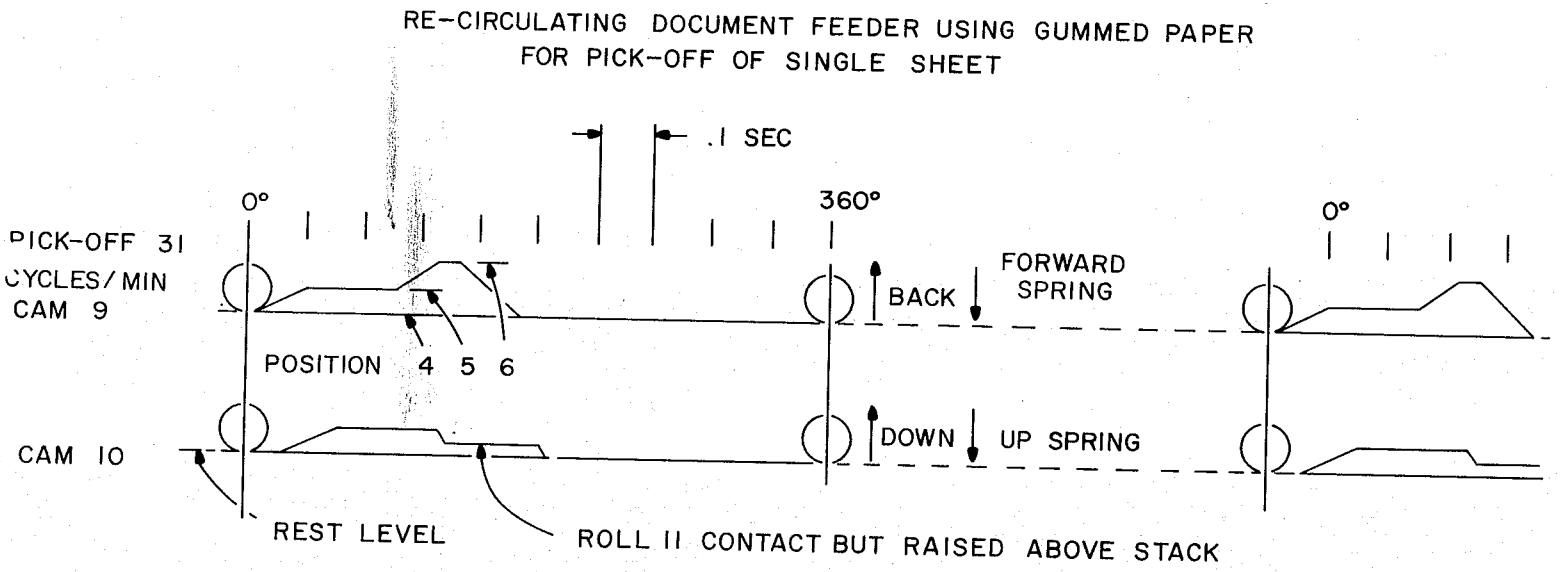

FIG. 4 shows positioning of the cartridge of FIG. 1 having carried the sheet of paper forward to be fed into the copying machine; and FIG. 5 is a timing diagram for the movement through the positions denominated 4, 5 and 6, respectively as shown in FIGS. 1, 2 and 3.

The objective of this invention is to present a thin strip 22 of adhesive material to the front edge of the top sheet 19 of a stack of blank sheets. A schematic diagram of the operation of the system appears in FIGS. 1B and 1C. As the top sheet 19 of the stack is contacted by the adhesive strip 22, the front edge 20 (FIG. 1B) is contacted and adheres to the strip. Some downward pressure is applied to the strip 22 to cause this adhesion, as represented by the arrow 24. The rounded surface carrying the adhesive strip 22 is then rotated in a direction indcated by arrow 26 away from the path which the paper will follow to be withdrawn from the stack. At the same time, the downward pressure indicated by arrow 24 is at least partially maintained. The result is that the sheet 19 now has its front edge lifted away from the remainder of the stack. The combination of the beam strength of the second sheet of paper 19-2 underlying the top sheet 19-1, and the downward pressure on this sheet 19-2, causes sheet 19-2 to continue to lie flat while the leading edge of the top sheet 19-1 is raised. Preferably a barrier 28 is provided adjacent the leading edge of the paper stack and at least as high as the stack. The lead edge of the top sheet 19-1 is raised above this barrier; the sheet can now be withdrawn in a direciton opposite the arrow 26 over the top of the barrier. The presence of the barrier prevents the sheet 19-2 or the rest of the stack from following.

FIG. 1A is a front elevational view of the gummed paper pick-off cartridge 10 shown in its at-rest position. This resting position of the cartridge is hereafter identified by its center line 4. The structure of the pick-off cartridge itself is substantially similar to presently known carbon film typewriter cartridges in construction. It carries a band of adhesive-surfaced paper which is moved past a slot in 7 in the bottom of cartridge 10, the slot 10 running in a direction perpendicular to the plane of the paper. This adhesive surface is rotated past slot 7 along a path indicated by dotted lines 7A, 7B. The exposed surface of this adhesive paper is of a temporary, no-residue adhesive such as butyl acrylate. The adhesive material is chosen on the basis that it is a temporary adhesive which when removed from the sheet to which is was temporarily adhered leaves no residue on or damage to that sheet. The cartridge may be used to pick up and advance successive sheets of paper as shown schematically in FIGS. 1B, 1C. In order to regularly present a fresh adhesive surface to the top of the stack at slot 7, the reel 9 in cartridge 10 is pinned to one finger 14 of a bifurcated cartridge support lever 16 by a pin 18. The pin 18 whose end is trapped between the two fingers 20, 22 may be advanced in small increments with the completion of each sheet feed cycle.

The lateral translation of the carriage to provide pick-up and advance of sheet 19 as outlined in FIGS. 1B, 1C is governed by the movement of cam follower 30 in response to rotation of cam 32. The successive positions to be reached by cartridge 10 to carry out the functions described with respect to FIGS. 1B and 1C are shown in FIGS. 1A, 2, 3 and 4. The timing of the paper pick-off operation is shown in FIG. 5. As a first step in picking up a sheet of paper (illustrated in FIG. 2), the cam 32 rotates, pushing against pivot wheel 34 causing forward movement of the lever portion 36 and the arm 16 carrying the cartridge 10 with it so that the center line of the cartridge is now at position 5.

It will be noted that to position the gummed edge of the cartridge (whose effective exposed width across slot 7 is indicated by the dashed lines 7A, 7B in FIG. 2) in contact with the leading edge of the sheet 19, the cartridge must be both moved to the rear from position 4 to position 5, and also must be lowered against the top sheet of papaer. This is because the rest position at position 4 is raised slightly above the blank sheets of peper in order to clear the barrier or fence 28 which is provided to restrain the stack of blank sheets against forward movement. The lateral movement of cartridge 10 is caused by rotation of the cam 32 moving cam follower 30 as the cam 32 surface rotates past the wheel 34. the necessary downward force to press cartridge 10 against sheet 19 as required in FIG. 2 is provided by the spring 46 connected between an end point 48 of a first cam follower and up/down lever 50 and a second connecting point 52 on the arm 54. This arm 54 rotates about the point 56 and has an end bearing 58 sliding in the slot 60 of the bifurcated arm 16. Because of the downward pressure created by the spring 46 against the point 52, the bearing 58 pulls down against the lower arm 14, providing a relatively weak but sufficient downward force of the cartridge 10 against the front edge of the paper 19. This tension spring 46 is designed to come into play to exert pressure downward on the cartridge in this position 5 to create adequate adhesion of the gummed strip to the lead edge of the top sheet. This pressure need only be fully effective at the end point of positioning the cartridge in position 5; the pressure may be relieved in part thereafter upon movement of the cartridge from position 5 (FIG. 2) to position 6 (FIG. 3), although some minimal pressure should be maintained.

The basic up/down movement of the cartridge is controlled by cam 62 rolling against cam follower 64 and rotating the cam follower arm 66 around the pivot 56. The small knob 68 is provided to produce a brief maximum pressure downward, pressing the cartridge 10 against the lead edge of the paper. It should be noted that the cam is designed and the timing arranged (FIG. 5) so that the maximum downward pressure created by the spring 46 preferably exists during a period when the cartridge is in position 5, so that the probability of picking up a single sheet is maximized.

FIG. 3 shows the cartridge backed up to a position defined by centerline 6. It may be slightly lifted off the paper stack compared to position 5. However, some pressure is still brought to bear on the top of the stack 19. More particularly, the cartridge is now rotated away from the exit path 70 so that the leading edge of the paper 19, which is now adhered to the adhesive strip whose exposed surface is defined by lines 40, 41 rolls up with the retreating motion of the cartridge. The leading edge of the top sheet is lifted off the second sheet and above the height of the paper stack restraining fence 28.

Breaking the leading edge of the top sheet free of the second sheet is aided by the fact that there is some pressure down on the stack while the cartridge is rotated away from the stack's leading edge as graphically illustrated in FIGS. 1B and 1C. The total extend of the movement to the rear of the cartridge is defined by the rotation of the surface of the cam 32 against follower surface 34, as well as the distance which the bearing 58 can slide in the slot 60. The up/down cam follower surface 62 has now moved to a lower level of the surface of the cam, so that the cartridge itself rises slightly above its position relative to the stack depicted in FIG. 2; this is illustrated in the time line of FIG. 5.

With the lead edge of the blank sheet 19 being curled upward, the cartridge 10 is now ready to be moved forward and bring the sheet 19 with it across the top of the fence 28. There being little frictional coupling between the sheet 19 and the adjacent document on top of the stack, only one sheet will be picked off.

FIG. 4 shows the cartridge 10 moved to a position where centerline 4 defines the position of the cartridge 10. The cartridge 10 remains slightly lower than its original position shown in FIG. 1, so it is in contact with the rotating roll 90. This is a soft rubber exit roll located in the center of the document and in line with the cartridge. With the cartridge 10 moved to the position defined by centerline 4, the paper 19 is captured between the cartridge and the roller 90. Rotation of the roll 90 will carry the document 19 into the document pick-off finger 92, causing the document 19 to be relesed from the cartridge and carried off to the entry path 94 between rollers 96, 97. Movement of the cartridge from the position shown in FIG. 3 to that shown in FIG. 4 is caused by the continued rotation of the cam 32 past the cam follower surface 34, the reduced surface of the cam 32 allowing or causing retraction of supporting arm 16 under the urging of spring 98. Return of cam follower 64 to a more reduced section of the cam 62 keeps the cartridge at the same height relative to the paper stack as it occupied in FIG. 3. A further reduction in surface height in the region 101 which the follower 64 reaches in the time period shown on the second line of FIG. 5 will cause the cartridge to be returned to the initial position shown in FIG. 1. As noted above, the cartridge 10 which carries the gummed material for adhering to the strips is similar in construction to a typewriter ribbon cartridge. Therefore, movement of the cartridge causes periodic advancement of the adhesive covered material, so that a fresh gummed strip periodically appears.

In summary, this invention provides a reliable, inexpensive, quiet system for moving single sheets of paper which is not damaging to the documents when used in the repetitive mode. Alternative embodiments of this invention may become apparent to a person of skill in the art who studies this invention disclosure. For example, means may be incorporated for lowering the height of said fence with reduction in the height of said stack so that sheets may continue to be easily withdrawn. Therefore, the scope of the present invention is to be limited only by the following claims.

What is claimed:

1. In an electrophotographic copying apparatus in which electrically charged toner of one polarity is transferred from an oppositely electrically charged surface of a photoconductive drum to the front side of a blank sheet for transforming said front side of the blank sheet into an intended copy as the back side of the blank sheet engages the surface of a transfer drum positioned adjacent said photoconductive drum, the transfer of toner taking place within a nip defined by said photoconductive drum and said transfer drum, an improved sheet feeder for transferring said single blank sheets from a stack of paper to an entry path to said transfer nip comprising a gummed paper cartridge mounted adjacent said stack of paper for picking up single sheets from said stack, means for positioning said cartridge in a first position adjacent a leading edge of said stack nearest said entry path, means operative when said cartridge is in said first position to move said cartridge to a second position more distant than said first position from said entry path, movement of said cartridge from said first to said second position causing lifting of a leading edge of said blank sheet for separate withdrawal thereof from said stack for transfer to said entry path, means for moving said cartridge from said second position adjacent said stack wherein said cartridge engages said top sheet of said stack along a translational path to a third position whereby said sheet is moved from said stack and presented to said entry path.

2. Apparatus as in claim 1 including means for causing said cartridge to press down on said stack when said cartridge is moving from said first to said second position, whereby the beam strength of a second sheet under said top sheet of said stack aids in separating said to blank sheet from said second blank sheet.

3. Apparatus as in claim 1 a fence located adjacent said stack at the edge of said stack facing said entry path, said fence being at least as high as the edge of said stack so that only said single blank sheet is moved to said entry path.

4. Apparatus as in claim 1 further comprising an exit roller located adjacent the edge of said paper stack facing said entry path and means for rotating said exit roller to forward said single blank sheet to said entry path.

5. Apparatus as in claim 4 wherein said cartridge moving means comprise means for moving said cartridge to said third position adjacent said exit roller, said blank sheet being captured between said exit roller and said cartridge, rotational movement of said exit roller forwarding said sheet to said entry path.

6. Apparatus as in claim 1 wherein said cartridge is cylindrical and has a gummed surface strip surface running parallel to an edge of said single blank sheet, said gummed strip contacting and holding a leading edge of said single blank sheet for transfer of said sheet to said entry path.

7. Apparatus as in claim 6 wherein said means for moving said cartridge from said first to said second position include means for rotating said cartridge toward said entry path during said movement, said gummed strip holding and lifting the leading edge of said single blank sheet as a result of said cartridge rotation for separation of the leading edge of said sheet from said stack and easy removal of said sheet.

8. Apparatus as in claim 7 a fence located adjacent said stack at the edge of said stack facing said entry path, said fence being at least as high as the edge of said stack so that only said single blank sheet is moved to said entry path.

9. In a copying apparatus wherein an intended image is formed on a single blank sheet of paper automatically fed through an entry path to an image transfer region, a sheet feeder for transferring said single blank sheets one at a time from a stack of paper to said entry path to said image transfer region comprising a transfer cartridge including a gummed region extending parallel to a leading edge of said single blank sheet facing said entry path, means for moving said cartridge from a first position contacting said single blank sheet to a second position more distant from said entry path whereby the leading edge of said blank sheet is separated from said stack of paper, and for moving said cartridge on a translational path from said second position to a third position wherein said blank sheet is presented to said entry path, and a fence means located adjacent said stack for restraining said stack from movement toward said entry path with movement of said single blank sheet.

10. Apparatus as in claim 9 further comprising an exit roller located adjacent the edge of said paper stack facing said entry path and means for rotating said exit roller to forward said single blank sheet to said entry path.

11. Apparatus as in claim 10 wherein said cartridge moving means comprises means for moving said cartridge to said third position adjacent said exit roller, said blank sheet being captured between said exit roller and said cartridge, rotational movement of said exit roller forwarding said sheet to said entry path.

12. Apparatus as in claim 11 wherein said means for moving said cartridge from said first to said second position include means for rotating said cartridge toward said entry path during said movement, said gummed strip holding and lifting the leading edge of said single blank sheet as a result of said cartridge rotation for separation of the leading edge of said sheet from said stack and easy removal of said sheet from said stack.

13. Apparatus as in claim 9 including means for lowering the height of said fence with reduction in the height of said stack.

14. Apparatus as in claim 13 further comprising an exit roller located adjacent the edge of said paper stack facing said entry path and means for rotating said exit roller to forward said single blank sheet to said entry path.

15. Apparatus as in claim 13 wheren said cartridge moving means comprise means for moving said cartridge to said third position adjacent said exit roller, said blank sheet being captured between said exit roller and said cartridge, rotational movement of said exit roller forwarding said sheet to said entry path.

* * * * *